United States Patent [19]

Yan et al.

[11] Patent Number: 4,604,188

[45] Date of Patent: Aug. 5, 1986

[54] THERMAL UPGRADING OF RESIDUAL OIL TO LIGHT PRODUCT AND HEAVY RESIDUAL FUEL

[75] Inventors: Tsoung Y. Yan, Philadelphia, Pa.; Paul Shu, Princeton Junction, N.J.

[73] Assignee: Mobil Oil Corporation, New York, N.Y.

[21] Appl. No.: 691,798

[22] Filed: Jan. 16, 1985

Related U.S. Application Data

[63] Continuation-in-part of Ser. No. 522,136, Aug. 11, 1983, abandoned.

[51] Int. Cl.[4] ..... C10G 9/00

[52] U.S. Cl. ..... 208/106; 208/125; 44/51; 44/56

[58] Field of Search ..... 208/50, 106, 125, 127, 208/128, 130; 44/51, 61, 56

[56] References Cited

U.S. PATENT DOCUMENTS

| | | | |
|---|---|---|---|
| 3,767,564 | 10/1973 | Youngblood et al. | 208/106 |
| 4,046,670 | 9/1977 | Seguchi et al. | 208/127 |
| 4,156,434 | 5/1979 | Parker et al. | 44/61 |
| 4,199,326 | 4/1980 | Fung | 44/51 |
| 4,395,266 | 7/1983 | Han | 44/51 |
| 4,478,602 | 10/1984 | Kelley et al. | 44/51 |
| 4,479,805 | 10/1984 | Batra | 44/61 |
| 4,481,101 | 11/1984 | Yan | 208/106 |
| 4,522,703 | 6/1985 | Yan et al. | 208/106 |

*Primary Examiner*—Andrew H. Metz
*Assistant Examiner*—Anthony McFarlane
*Attorney, Agent, or Firm*—Alexander J. McKillop; Michael G. Gilman; Charles J. Speciale

[57] ABSTRACT

A method of upgrading residual oil includes cracking the residual oil at a severity which is between visbreaking and coking to produce a light cracked product and a heavy bottom product. The heavy bottom product is mixed with diluents and additives which improves the flow characteristics to produce a pumpable fuel.

24 Claims, 3 Drawing Figures

Softening Point (fusion temp.) vs Residence time

THERMAL UPGRADING OF RESIDUAL OIL TO LIGHT PRODUCT AND HEAVY RESIDUAL FUEL

RELATED APPLICATIONS

This application is a continuation-in-part of application Ser. No. 522,136 filed Aug. 11, 1983, and now abandoned.

Ser. No. 554,013, filed Nov. 21, 1983, "THERMAL TREATMENT OF HEAVY HYDROCARBON OIL", Yan and Chen now U.S. Pat. No. 4,522,703, and "DILUENTS FOR REDUCING VISCOSITY OF HEAVY FUELS", Yan and Shu, Ser. No. 522,131, filed Aug. 11, 1983 are incorporated herein by reference.

BACKGROUND OF THE INVENTION

This invention relates to the upgrading of petroleum residua, and more particularly, to the production of marketable fuel.

Residual petroleum oil fractions produced by atmospheric or vacuum distillation of crude petroleum are characterized by a relatively high metals content. This occurs because substantially all of the metals present in the original crude remain in the residual fraction. Principal metal contaminants are nickel and vanadium, with iron and small amounts of copper sometimes being present.

The high metals content of the residual fractions generally preclude their effective use as chargestocks for subsequent catalytic processing, such as catalytic cracking and hydrocracking, because the metal contaminants deposit on the special catalysts for these processes and cause the formation of inordinate amounts of coke, dry gas, and hydrogen.

It is current practice to upgrade certain residual fractions by a pyrolytic operation known as coking. In this operation the residuum is destructively distilled to produce distillates of low metals content and leave behind a solid coke fraction that contains most of the metals. Coking is typically carried out in a reactor or drum operated at about 800° F.–1000° F. temperature and a pressure of 1–10 atmospheres. The economic value of the coke byproduct is determined by its quality, particularly its sulfur and metals content. Excessively high levels of these contaminants make the coke useful only as low-valued fuel.

Coking has long been the most important process for upgrading of resid. Because of worsening of crude quality and improvements in vacuum distillation and catalytic cracking technologies, the quality of coker feed has been deteriorating for years. At the present time, the low quality coke produced by some refineries has become difficult to market.

In U.S. Pat. No. 4,317,717, T. Y. Yan, "CO-PROCESSING OF RESIDUAL OIL AND COAL", residual oil is reacted with coal under visbreaking conditions to demetalize the residual oil. In "PRODUCTION OF LOW METAL AND LOW SULFUR COKE FROM HIGH METAL AND HIGH SULFUR RESIDS" Ser. No. 411,141, filed Aug. 25, 1982, T. Y. Yan, high quality coke is produced from demetalized residual oil which was visbroken with coal or other particulate solids. The visbroken stream is separated into overflow and underflow streams using a settler. The low metal overflow is charged into a coker to produce the desirable low metal coke. As described in that application, the underflow is recycled to the reactor where the particulate solids perform demetalation of the residual oil.

As a heavy fuel, the most difficult specification for the residua to meet is viscosity and/or pour point. For instance, the heavier marine diesel fuel requires a pour point of 30° C. and viscosity at 100° C. of about 60 CST, while the pour point of the resid from a typical coker feed is about 60° C. In order to reduce the viscosity of residua to an acceptable level, light fractions, such as kerosene and light cycle oil are added as the cutter stocks. The quantities of cutter stocks required for typical residua are 35 to 50%. These cutter stocks are expensive relative to the residua. As a result, the visbreaking process has become more popular in recent years. The visbreaking process generates cutter stock from the resid itself by mild thermal cracking. However, the visbreaking often leads to fuel instability.

It is an object of the present invention to avoid the production of solid coke in residual oil upgrading.

It is another object of the present invention to produce a marketable fuel from heavy residual oil.

It is another object of the present invention to provide a residual oil upgrading process which is less expensive in both capital and operational costs.

SUMMARY OF THE INVENTION

In accordance with the invention, residual oil is thermally cracked at a severity which is between visbreaking and coking. This produces a light cracked product which is useful in itself. In accordance with the invention, the heavy bottom product of this thermal cracking is mixed with a diluent which improves the flow characteristics and produces a pumpable fuel which is marketable. The cracking takes place at a severity which produces the maximum light product, without the formation of solid coke, and with a residual which is emulsifiable with a diluent. More specifically, the heavy bottom product is mixed with water and additives which produce a fuel with the desired pour point.

The foregoing, and other objects, features and advantages of the invention will be better understood from the following more detailed description and appended claims.

SHORT DESCRIPTION OF THE DRAWINGS

DESCRIPTION OF THE PREFERRED EMBODIMENT

Figure 1:
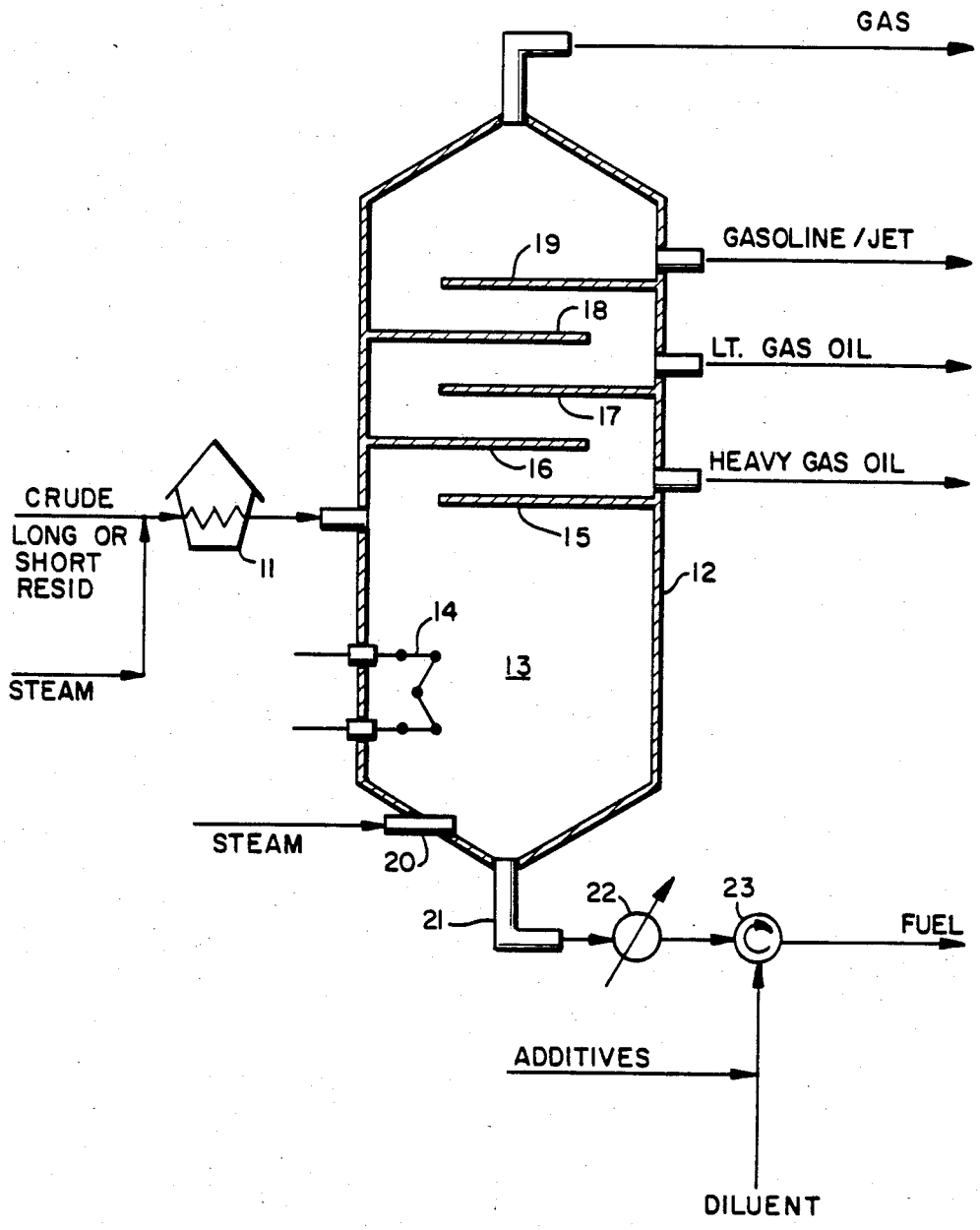
FIG. 1 shows a reactor which produces residual oil which is thermally cracked in the bottom of the reactor in accordance with the invention.

Crude or resids, preferably long resid, is heated along with steam in a tubular heater 11 to 650°–900° F. (preferably 750°–850° F.) at 0 to 1,000 psig (preferably 1 to 20 LHSV). The steam to resid ratio is 0.01 to 10 (preferably 0.1 to 1). The effluence is charged and flashed into the reactor 12. The bottom section 13 of the reactor is an empty vessel with a heater 14. The top section of the reactor is equipped with distillation trays 15–19. Typically 15–20 trays are provided. These are at properly located take-off points for withdrawing products.

The severity in the bottom section 13 is maintained at 650°–900° F. (preferably 750°–850° F.) 0 to 100 psig (preferably 1 to 50 psig) and residence time to 0.1 to 5 hours. The thermal cracking of residual oil occurs in this section. The temperature and residence time has to be adjusted according to the nature of the feed to obtain a heavy bottom product of the desired pour point. The higher the severity (i.e., higher temperature and longer residence time) the higher the light product yield and higher the pour point of the heavy bottom product.

The cracked product in vapor form rises through the top of the section, is fractionated into the desirable cuts and recovered by trays 15–19. In order to promote more complete stripping light products, additional steam is added through conduit 20 at the bottom of the section 13.

The heavy bottom product from the reactor section is withdrawn through conduit 21 and cooled to about 400° F. in heat exchanger 22. To this bottom product diluents and additives are added and homogenized at 23 to improve the flow characteristics (e.g., lowering pour point). The diluents are naphtha, kerosene, light oil, alcohols and preferably water. The preferred additives are surfactants, synthetic detergent and inexpensive petroleum sulfonates.

Figure 2:
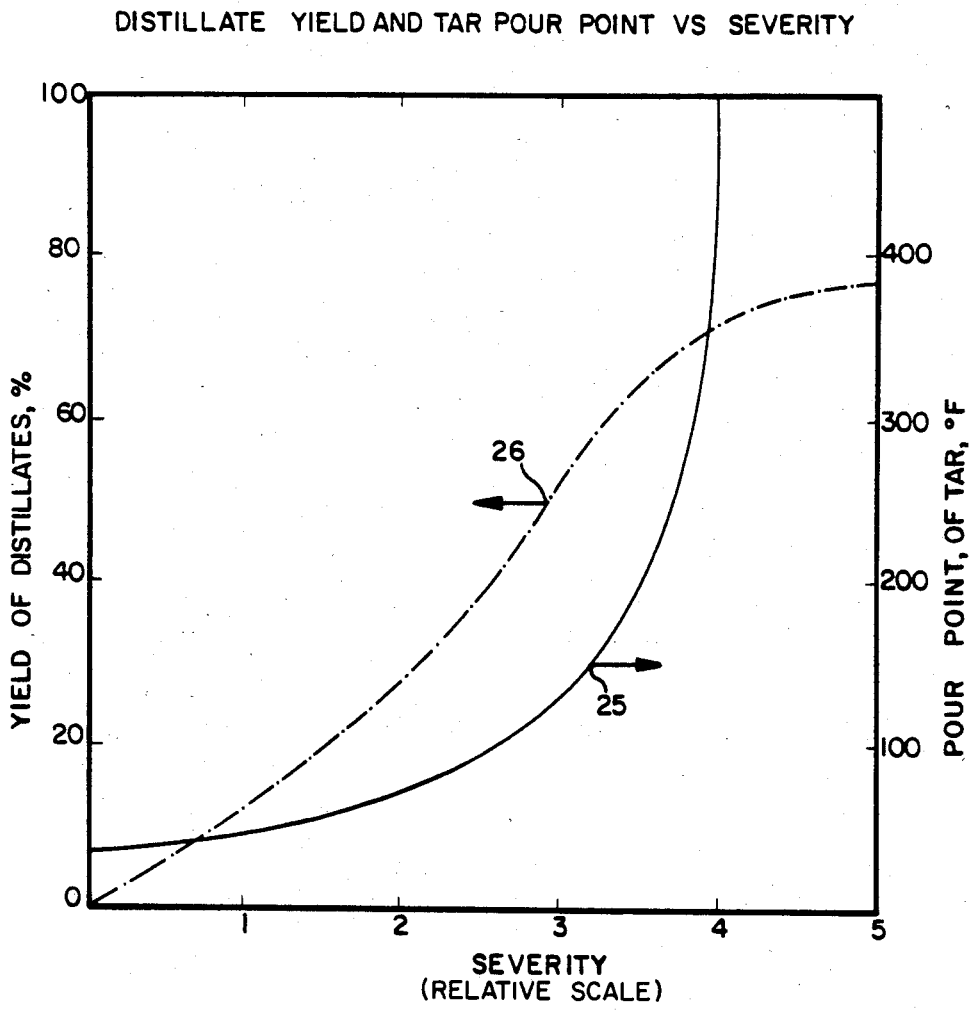
FIG. 2 shows the yield of distillates and the pour point as a function of severity.

In accordance with the present invention, thermal cracking of the residual oil in the bottom section 13 of the reactor is carried out at a severity which is between visbreaking and coking. This can be better understood from FIG. 2 wherein the solid line shows the pour point of produced products as a function of severity and the dashed line shows the yield of distillates. Coking takes place at a severity which is greater than the point marked 25 where the pour point of the resulting product increases rapidly, thereby producing coke. As previously indicated, the production of coke is generally uneconomical. Visbreaking takes place at severities less severe than indicated at 26, where the yield of distillates is less than 50%. In accordance with the present invention, the thermal cracking which is carried out is between the severity of visbreaking and the severity of coking. FIG. 2 shows severity on merely a relative scale of 1–5.

The severity of thermal treatment conditions can be expressed in terms of Severity (S), which is equal to Soaking Factor multiplied by reaction time. The parameters are reaction temperature and reaction time.

Severity is conveniently expressed in terms of "equivalent reaction time in seconds" (ERT), as measured at 800° F.

The expressions "Severity" (S) and "Soaking Factor" (SF) as employed herein refer to the following relationship of thermal treatment parameters:

$$\text{Severity (S)} = \text{Soaking Factor } (SF_{800}) \times \text{Residence Time } (\theta)$$

The relationship for the soaking factor for the whole coil reactor is more specifically set forth in application Ser. No. 554,013, identified above.

Typically, the highest severity conditions in the thermal treatment zone will be in the range between about 1,000–18,000 seconds, as expressed in equivalent reaction time at 800° F.

As the severity level in a thermal treatment zone increases, the yield of light product, including gas and oil, increases, and the fusion temperature (ASTM D 3104-77 or ASTM D 2319-76) and the quinoline-insoluble content of the heavy bottom product increases. For each residual oil feedstock there is a highest severity level which achieves the desired balance of light product and relative to the yield of heavy bottom product which has a fusion temperature below about 150° C. (302° F.) and a quinoline-insoluble content between about 20–50 wt %, essentially without any formation of coke byproduct. It is important that the fusion temperature of the heavy bottom product be below about 150° C. so that it can be emulsified in accordance with the invention.

In addition to severity, the yield and quinoline-insoluble content of the heavy bottom product are quantities which are functionally related to the asphaltene content of the starting heavy oil feedstock. As demonstrated by the data in the examples, nominally the asphaltene content of the heavy hydrocarbon oil relates to the bottom product yield and quinoline-insoluble content in accordance with the following equation:

$$\text{wt \% asphaltenes} \cdot \frac{\text{wt \% quinoline} - \text{insolubles}}{\text{wt \% bottom product yield}}$$

The quinoline-insoluble content of the product can be determined by means of ASTM D 2318-76. The operating range for the inventive process is narrow and specific to each feedstock (e.g., the Khafji and Minas resids of the following examples).

Experiments show that about 50% of a light product can be obtained by thermally cracking 1050° F.+ coker feed mildly at 820° F., 0 psig, 2 hour residence time and steam to oil ratio of 0.1. The heavy bottom product has a pour point of about 280° F. With 20% of water containing 1% of petroleum sulfonates (TRS 1080), the pour point was lowered to below 200° F. The yields from such thermal cracking of two types of residual oil are shown in the table below.

TABLE

| RESID | A. MINAS | B. KHAFJI |
|---|---|---|
| Properties | | |
| Specific gravity, 15/4° C. | 0.937 | 1.032 |
| C.C.R., wt, % | 10.4 | 20.9 |
| Asphaltenes, wt. % | 5.1 | 16.8 |
| Pour Point, °C. | 47.5 | 62.5 |
| Sulfur, wt. % | | 5.43 |
| Ni, ppm | 37.2 | 52.0 |
| V, ppm | | 154 |
| Reaction Temp., °C. | 465 | 465 |
| Reaction Time, min. | 110 | |
| Product Yield, wt. % | | |
| Gas | 4.0 | 6.0 |
| Oil | 66.0 | 51.0 |
| Residue | 30.0 | 43.0 |
| Heavy Residual Fuel Inspection | | |
| Volatile Matter, wt. % | 42 | 44 |
| Quinoline insoluble, wt. % | 50 | 23 |
| Fusion Temp., °C. | 150 | 150 |

Figure 3:
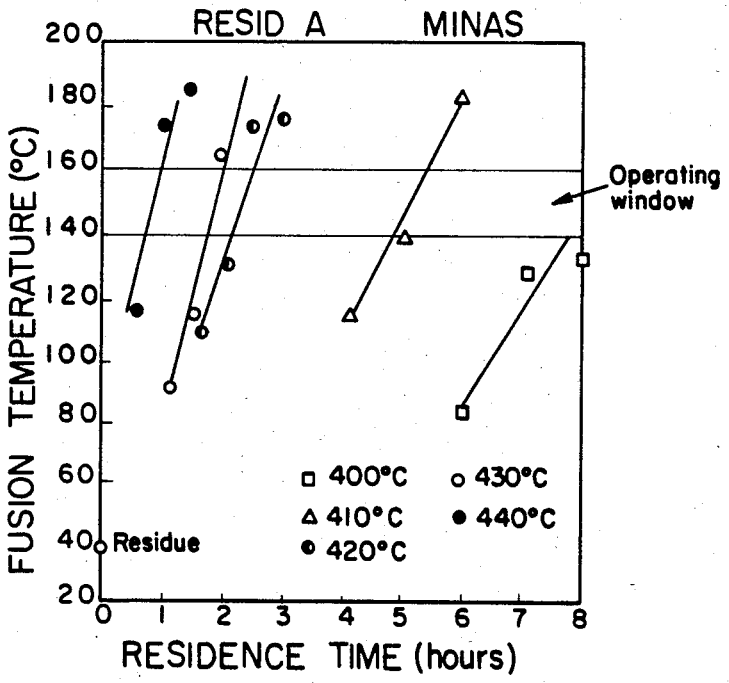
FIG. 3 shows fusion temperature vs. residence time for two types of crude.
Figure 3:
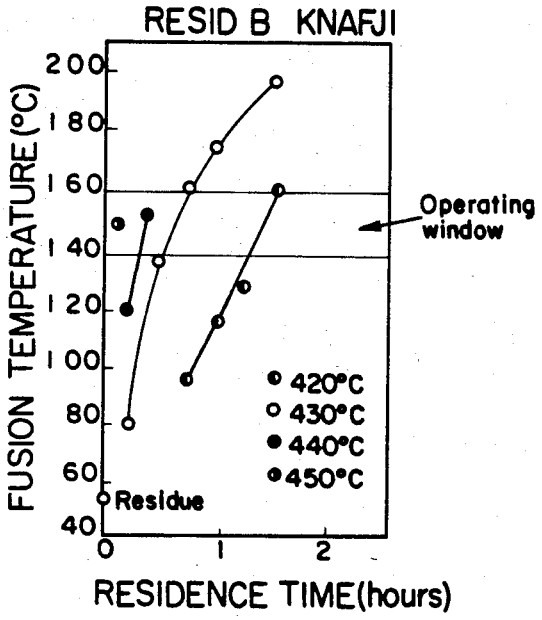

The selected severity conditions in the inventive process are narrow and specific for each feedstock. For each temperature, the variation in residence time to obtain bottom product with a fusion temperature below about 150° C. is narrow (see FIG. 3). Similarly, for each residence time, the operable temperature is very narrow. The nature of the resid feedstock is critical in deciding this operable severity due to their differences in reactivity. In FIG. 3, resid B is much more reactive than resid A. The Khafji resid is much more reactive than the Minas resid, but the operating window for each resid is very narrow within the overall operation range encompassing all kinds of residua.

Cracking the residual oil at the severity of the present invention, a maximum amount of desirable light product is obtained, no coke is produced and the residual heavy bottom product is emulsifiable. Since the fusion temperature of the heavy bottom product is between 100° and 150° C. (preferably 100°-140° C.) the emulsification, preferably with water, takes place at a high temperature. Accordingly, the emulsification must take place under pressure, typically in the range of 20-500 psig.

Some residua contains a substantial amount of natural surface active agents, such as naphthenates so that the resid/water mixture can become an emulsion upon homogenization. However, caustics, including ammonia, amines or surfactants or both can be added to improve the stability of the emulsion. The caustic can be added to neutralize the acids in the residua and preferably, in excess of this neutralization so as to make the solution basic with pH of 7.5 to 12 (preferably 9 to 11). The heavy residua often contain sulfur compounds in excess of 1 wt. % which are corrosive to the combustion systems. It was found that at the high pH level preferred in this invention, the corrosion problem is significantly alleviated. The surfactants can be added to improve the stability of the emulsion at between 0.01 to 5% preferably 0.01 to 2%). Surfactants of all kinds, cationic, anionic, non-ionic and amphoteric can be employed. However, from a cost point of view, the cheap anionic surfactants are preferred. These include petroleum sulfonates, lignin sulfonates, alkyl benzene sulfonates, alkyl alkylsulfonates, stearates, oleates, sulfonate of tall oil, soap of vinsol resid (pine-chip-resin extract), soap of fatty acid pitch, naphthenates, and cresylates.

The surfactants can be produced in situ. For instance, the residua itself can be sulfonated and neutralized with base in situ. Similarly, tall oil acid and the base can be added in the process to produce the soap in situ.

NaOH, KOH, $Ca(OH)_2$, NHOH, $Na_2CO_3$, and amines can be used as the base. NaOH and $Na_2CO_3$/-$NaHCO_3$ are the least expensive bases and preferred, but, for some critical uses, $NH_4OH$ or amines may have to be used.

In general, the higher the water content, the lower the viscosity of the product. Addition of water up to 10-15% of the mixture improves the thermal efficiency and decreases the emission of particulates and $NO_x$ in the combustion. However, too much water will lead to a decrease in thermal efficiency due to excessive heat loss to the stack. Therefore, the water content in the product should be minimized. Up to 30% water is a practical range.

We have discovered that to minimize the water content required for a given product viscosity, the external phase is preferred to be water in the emulsion. In order to make the water in the external phase, the surfactant preferred should be more soluble in water than in the oil. One of the useful rules for this choice is use of the solubility parameter proposed by Hildebrand. According to this rule, the solubility parameter of the surfactants should be as close to water and as far away from the oil as possible. Because of the differences in the residua, the final choice of best surfactants can only be determined experimentally.

The stability of the emulsion should be high, i.e., stable for long periods of storage; able to endure cycles of temperature fluctuation, including freezing/thawing in storage. It has been discovered that mixtures of surfactants are more effective than a single surfactant, particularly in which one of the combination of surfactants is soluble in water and the other is soluble in oil. Addition of 0.1 to 1% of lignosulfonate also helps stabilize the emulsion. In addition, 0.01 to 0.5 wt. % of CMC (carboxymethylcellulose) is effective in stabilizing the emulsion. Incorpration of polycyclic aromatic hydrocarbons having a maximum of three rings, such as FCC light cycle oil are found to be useful in reducing settlement in emulsions during storage.

The addition of a small amount (0.5 to 10%) of light hydrocarbon improves the viscosity cutting power of water significantly. This light hydrocarbon can be premixed with residua in the preparation of the emulsion. Aromatic hydrocarbons are more effective than paraffins for this purpose. The preferred stocks are light catalytic cycle stock, kerosene, heavy naphthas from coker, catalytic cracker and reformer.

While a particular embodiment of the invention has been shown and described, various modifications are within the true spirit and scope of the invention. The appended claims are, therefore, intended to cover all such modifications.

What is claimed is:

1. The method of upgrading residual oil boiling in the range of 1050° F.+ comprising:

thermally cracking said residual oil at a temperature of 650°-900° F., a pressure of 0-100 psig, and a residence time of 0.1 to 5 hours at the highest severity in the range between about 1,000-18,000 seconds, as expressed in equivalent reaction time at 800° F., sufficient to convert at least about 50 wt. % of the residual oil to light products, substantially without the formation of solid coke;

recovering separate fractions of light product and emulsifiable heavy bottom product which has a fusion temperature below about 150° C. and a quinoline-insoluble content between about 10 wt. % and 30 wt. % and wherein the highest severity is determined by a functional relationship between the asphaltene content of the residual oil feedstock and the heavy bottom product yield and quinoline-insoluble content in accordance with the followinng:

$$\text{wt. \% asphaltenes} \cdot \frac{\text{wt \% quinoline} - \text{insolubles}}{\text{wt \% bottom product yield}} =$$

a value ranging between 6 and 12.

2. The method recited in claim 1 further comprising emulsifying said heavy bottoms product with a diluent wherein said diluent is selected from the group consisting of naphtha, kerosene, light oil, alcohols, and water.

3. The method recited in claim 2 wherein said diluent is water.

4. The method recited in claim 1 further comprising: mixing said heavy bottom product with an additive which improves the flow characteristics.

5. The method recited in claim 4 wherein said additive is selected from the group consisting of surfactants and synthetic detergents.

6. The method recited in claim 2 wherein the emulsification is carried out at a pressure of 20-500 psig.

7. The method recited in claim 5 wherein said temperature is maintained at a range of 750°-800° F. and said pressure is maintained at a range of 1-50 psig.

8. The method recited in claim 1 wherein the step of thermally cracking said residual oil is carried out in the bottom of a reactor, which has distillation trays for withdrawing products from the top thereof, said method further comprising:

supplying a light hydrocarbon oil to said reactor;

thermally cracking said hydrocarbon oil in said reactor to produce light cracked products and heavy bottom product; and removing said light cracked products from the distillation tray of said reactor.

9. The method recited in claim 4 further comprising mixing said heavy bottom product with a diluent said diluent comprising water, and:

emulsifying said heavy bottom product with said diluent to produce an emulsion.

10. The method recited in claim 9 further comprising: mixing said emulsion with an additive which improves the stability of the emulsion.

11. The method recited in claim 10 wherein the additive is selected from the group consisting of caustics, amines, and surfactants.

12. The method recited in claim 10 wherein said additive is a caustic added in an amount which neutralizes the acids in said heavy bottom product to make the solution basic with a pH of between 7.5 and 12.

13. The method recited in claim 10 wherein said additive is a surfactant added at 0.01–5% by volume.

14. The method recited in claim 10 wherein said additive is a surfactant selected from the group consisting of cationic, anionic, nonionic, and amphoteric surfactants.

15. The method recited in claim 10 wherein said surfactant is selected from the group consisting of lignin sulfonates, alkyl benzene sulfonates, alkyl alkylsulfonates, stearates, oleates, sulfonate of tall oil, soap of tall oil, soap of Vinsol resid, (pine-chip-resin extract), soap of fatty acid pitch, naphthenates and cresylates.

16. The method recited in claim 9 wherein the stability of the emulsion is improved by a surfactant produced in situ by sulfonating and neutralizing said bottom product.

17. The method recited in claim 16 wherein said heavy bottom product is neutralized with a base selected from the group consisting of NaOH, KOH, $Ca(OH)_2$, $NH_4OH$, $Na_2CO_3/NaHCO_3$.

18. The method recited in claim 9 wherein said heavy bottom product is emulsified with water in an amount of up to 30% by volume.

19. The method recited in claim 10 wherein said additive is a surfactant which is more soluble in water than in oil.

20. The method recited in claim 9 further comprising: mixing the emulsion with a combination of surfactants, at least one which is soluble in water and another of which is soluble in oil.

21. The method recited in claim 9 further comprising: adding 0.1–1% of lignosulfate to the emulsion to stabilize said emulsion.

22. The method recited in claim 9 further comprising: adding 0.01 to 0.5 wt. % of carboxymethyl cellulose to the emulsion to stabilize said emulsion.

23. The method recited in claim 9 further comprising: adding polycyclic aromatic hydrocarbons having a maximum of three rings to the emulsions to reduce settling during storage.

24. The method recited in claim 9 further comprising: adding 0.5–10% of light hydrocarbon oil to the emulsion to improve the viscosity reducing characteristics of water, said light hydrocarbon being selected from the group consisting of:

light catalytic cycle stock, kerosene, heavy naphthas from coker, catalytic cracker and reformer.

* * * * *